US012178246B2

(12) United States Patent
Liu

(10) Patent No.: US 12,178,246 B2
(45) Date of Patent: Dec. 31, 2024

(54) CLEAROMIZER, CARTRIDGE, AND ELECTRONIC CIGARETTE

(71) Applicant: Shenzhen Eigate Technology Co., Ltd., Shenzhen (CN)

(72) Inventor: Tuanfang Liu, Shenzhen (CN)

(73) Assignee: Shaofang Wang, Ji'an (CN)

( * ) Notice: Subject to any disclaimer, the term of this patent is extended or adjusted under 35 U.S.C. 154(b) by 484 days.

(21) Appl. No.: 17/518,560

(22) Filed: Nov. 3, 2021

(65) Prior Publication Data

US 2022/0295883 A1 Sep. 22, 2022

(30) Foreign Application Priority Data

Mar. 17, 2021 (CN) ..... 202120550980.8
May 6, 2021 (CN) ..... 202120946908.7

(51) Int. Cl.
*A24F 40/42* (2020.01)
*A24F 40/10* (2020.01)
*A24F 40/485* (2020.01)

(52) U.S. Cl.
CPC ..... *A24F 40/42* (2020.01); *A24F 40/10* (2020.01); *A24F 40/485* (2020.01)

(58) Field of Classification Search
CPC ..... A24F 40/42; A24F 40/485; A24F 40/10
USPC ..... 31/329
See application file for complete search history.

(56) References Cited

U.S. PATENT DOCUMENTS

| | | | | |
|---|---|---|---|---|
| 10,383,368 | B2 * | 8/2019 | Larson | A24F 40/40 |
| 11,439,183 | B2 * | 9/2022 | Woodcock | G08B 21/182 |
| 11,602,174 | B2 * | 3/2023 | Angell | A24F 40/46 |
| 11,647,787 | B2 * | 5/2023 | Liu | A24F 40/40 131/329 |
| 11,653,700 | B2 * | 5/2023 | Liu | A24F 40/46 131/329 |
| 2016/0227837 | A1 * | 8/2016 | Hammel | A24D 3/17 |
| 2018/0303162 | A1 * | 10/2018 | Zhang | A24F 40/485 |
| 2022/0142257 | A1 * | 5/2022 | Austin | A24F 40/30 |
| 2022/0256923 | A1 * | 8/2022 | Aggarwal | A24F 40/46 |
| 2022/0273030 | A1 * | 9/2022 | Liu | A24F 40/485 |
| 2022/0354168 | A1 * | 11/2022 | Stuart | A24F 40/42 |
| 2023/0210173 | A1 * | 7/2023 | Shen | A24F 40/485 131/329 |
| 2023/0354892 | A1 * | 11/2023 | Wen | A24F 40/70 |
| 2023/0354904 | A1 * | 11/2023 | Shen | A24F 40/485 |

* cited by examiner

*Primary Examiner* — Abdullah A Riyami
*Assistant Examiner* — Vladimir Imas
(74) *Attorney, Agent, or Firm* — MATTHIAS SCHOLL P.C.; Matthias Scholl

(57) ABSTRACT

A clearomizer includes a first main body and a second main body. The first main body includes a first distal end away from the second main body; the first distal end includes a mouthpiece. The second main body includes a second distal end away from the first main body. The clearomizer further includes a first conductive connector and a second conductive connector both disposed on the second distal end.

16 Claims, 16 Drawing Sheets

CLEAROMIZER, CARTRIDGE, AND ELECTRONIC CIGARETTE

CROSS-REFERENCE TO RELATED APPLICATIONS

Pursuant to 35 U.S.C. § 119 and the Paris Convention Treaty, this application claims foreign priority to Chinese Patent Application No. 202120550980.8 filed Mar. 17, 2021, and to Chinese Patent Application No. 202120946908.7 filed May 6, 2021. The contents of all of the aforementioned applications, including any intervening amendments thereto, are incorportated herein by reference. Inquiries from the public to applicants or assignees concerning this document or the relatd applications should be directed to: Matthias Scholl P.C., Attn.: Dr. Matthias Scholl Esq., 245 First Street, 18th Floor, Cambridge, MA 02142.

BACKGROUND

The disclosure relates to a clearomizer, a cartridge, and an electronic cigarette.

Conventional electronic cigarettes include a clearomizer and a cartridge unstably connected to the clearomizer. The clearomizer may be secured to the cartridge through threads. However, such a connection makes assembly and disassembly of the electronic cigarettes inconvenient.

SUMMARY

The first objective of the disclosure is to provides a clearomizer; the clearomizer comprises a first main body and a second main body; the first main body comprises a first distal end away from the second main body; the first distal end comprises a mouthpiece; the second main body comprises a second distal end away from the first main body; the clearomizer further comprises a first conductive connector and a second conductive connector both disposed on the second distal end; the first conductive connector is formed integrally with the second conductive connector or can be affixed thereto using welding or adhesives.

In a class of this embodiment, the second main body has a reduced diameter with respect to the first main body; the first main body comprises a first proximal end disposed near the second main body and a convex edge protruding from the first proximal end; the convex edge abuts against one end of a cartridge.

In a class of this embodiment, the second distal end comprises at least one recess and an air conduction hole disposed in the at least one recess; the at least one recess communicates with the air conduction hole and extends from side to side through the second distal end; the at least one recess is configured to conduct air into the air conduction hole; the second main body is disposed in a cavity of the cartridge and the second distal end abuts against a bottom wall of a column tube, so that air flows through the at least one recess and enters the clearomizer via the air conduction hole.

In a class of this embodiment, the first main body comprises a chamfer disposed to an edge of the first distal end; the at least one recess extends to the chamfer; when the second main body is disposed in the cavity, the second distal end abuts against the bottom wall of the column tube, thus forming a channel at the chamfer; air flows through an air inlet of the cartridge, the channel, the at least one recess, and the air conduction hole, and enters the clearomizer; the air flows along such a tortuous route, which prevents the condensed e-liquid from flowing outs of the atomizer and staining the atomizer.

In a class of this embodiment, the air conduction hole is disposed outside a central area of the second distal end. In this way, the leaked e-liquid from the atomizer is prevented from flowing into the battery, thus preventing short circuit.

In a class of this embodiment, the first conductive connector and the second conductive connector are symmetrically disposed relative to a straight center line of the second distal end. The In a class of this embodiment, the first conductive connector and the second conductive connector each are a singular conductive metal attractable by a magnet; a third conductive connector and a fourth conductive connector are disposed in the cavity of the cartridge; when the singular conductive metal is a free cutting steel, the third conductive connector and the fourth conductive connector individually comprise a conductive metal and a magnet; the conductive metal is hollow and the magnet is disposed within the conductive metal; or the magnet is hollow and the conductive metal is disposed within the magnet; or the conductive metal and the magnet are connected in parallel. Free cutting steel is a conductive material that is magnetically attracted, simple in structure, and easy to be processed.

In a class of this embodiment, the first conductive connector comprises a first electrode and a first magnetic attraction member; the first magnetic attraction member is hollow and is disposed around an outer periphery of the first electrode; or the first electrode is hollow and is disposed around an outer periphery of the first magnetic attraction member; or the first magnetic attraction member and the first electrode are connected in parallel; the second conductive connector comprises a second electrode and a second magnetic attraction member; the second magnetic attraction member is hollow and is disposed around an outer periphery of the second electrode; or the second electrode is hollow and is disposed around an outer periphery of the second magnetic attraction member; or the second magnetic attraction member and the second electrode are connected in parallel; the first electrode and the second electrode separately comprise a conductive metal, such as, but not limited to, copper, silver, aluminum, and gold; the first magnetic attraction member and the second magnetic attraction member separately comprise a magnet; the third conductive connector and the fourth conductive connector may comprise free cutting steel for electricity conducting and magnetic attraction; or the third conductive connector comprises a third electrode and a third magnetic attraction member respectively connected to the first electrode and the first magnetic attraction member, and the fourth conductive connector comprises a fourth electrode and a fourth magnetic attraction member respectively connected to the second electrode and the second magnetic attraction member.

In a class of this embodiment, the cross-section of the second main body is centrosymmetric around a central point.

In a class of this embodiment, the cross-section of the second main body has a length of 15-21 mm.

Preferably, the cross-section of the second main body has a length of 18-18.6 mm.

In a class of this embodiment, the cross-section of the second main body has a width of 7-12 mm.

Preferably, the cross-section of the second main body has a width of 9-9.6 mm.

In a class of this embodiment, the second main body has a height of 15-27 mm.

Preferably, the second main body has a height of 19-23.5 mm, preferably 19.3-20.5 mm or 21.8-23 mm.

In a class of this embodiment, the cross-section of the second main body comprises four identical smooth curves connected to one another; and each smooth curve comprises a first arc segment, a second arc segment, a third arc segment, and a fourth arc segment connected sequentially to one another.

In a class of this embodiment, the first arc segment is a segment of a circle with a radius of 3.3-4.2 mm and has a central angle of 13.5°-16.5°; the second arc segment is a segment of a circle with a radius of 5-6 mm and has a central angle of 12.7°-15.7°; the third arc segment is a segment of a circle with a radius of 14.5-15.5 mm and has a central angle of 18°-21.5°; the fourth arc segment is a segment of a circle with a radius of 18.1-19.1 mm and has a central angle of 39.5°-42°.

In a class of this embodiment, the outer perimeter of the second main body comprises two second arc segments and two third arc segments, and the two second arc segments and the two third arc segments are alternately connected in sequence and are centrosymmetric around a central point.

In a class of this embodiment, each of the two second arc segment is a segment of a circle with a radius of 17.5-19.5 mm and has a central angle of 146°-153°; and each of the two third arc segment is a segment of a circle with a radius of 12-14 mm and has a central angle of 27°-34°.

In a class of this embodiment, the cross-section of the second main body has a length of 18-18.8 mm and a width of 9.5-10.5 mm.

In a class of this embodiment, the outer perimeter of the second main body further comprises the fourth arc segment disposed between the second arc segment and the third arc segment; the fourth arc segment is a segment of a circle with a radius of 0.2-0.6 mm and has a central angle of 1°-3°.

In a class of this embodiment, the first conductive connector and the second conductive connector each are a singular conductive metal attractable by a magnet; and a distance between centers of the first conductive connector and the second conductive connector is within a range of 9-11 mm.

In a class of this embodiment, the first conductive connector and the second conductive connector both have a diameter of 4-7 mm.

The second objective of the disclosure is to provide a cartridge; the cartridge comprises a column tube for accommodating the clearomizer, a third conductive connector, and a fourth conductive connector; the column tube comprises an open top, a cavity, and a bottom wall; the second main body is inserted through the open top into the cavity; the third conductive connector and the fourth conductive connector are disposed on the bottom wall and are electrically connected to the first conductive connector and the second conductive connector, respectively.

In a class of this embodiment, the cartridge further comprises an air conduction column and the bottom wall of the column tube comprises a concave portion; the air conduction column is disposed in the concave portion; the first conductive connector and the second conductive connector are disposed outside the concave portion.

In a class of this embodiment, the cartridge further comprises a battery, a circuit element, a bracket and a housing communicating with the column tube; the bracket is disposed in the housing; the battery and the circuit element are disposed in the bracket; the bracket comprises a top portion functioning as the bottom wall of the column tube; the column tube comprises at least one air inlet above the bottom wall; the housing is integrally formed with the column tube or can be affixed thereto using welding, adhesives, or the like; the column tube and the housing can come in different colors to improve visual appearance.

In a class of this embodiment, the third conductive connector and the fourth conductive connector each are a singular conductive metal attractable by a magnet; when the conductive metal is free cutting steel, the first conductive connector and the second conductive connector individually comprise a conductive metal and a magnet; the conductive metal is hollow and the magnet is disposed within the conductive metal; or the magnet is hollow and the conductive metal is disposed within the magnet; or the conductive metal and the magnet are connected in parallel. Free cutting steel is a conductive material that is magnetically attracted, simple in structure, and easy to be processed.

In a class of this embodiment, the third conductive connector comprises the third electrode and the third magnetic attraction member; the third magnetic attraction member is hollow and is disposed around an outer periphery of the third electrode; or the third electrode is hollow and is disposed around an outer periphery of the third magnetic attraction member; or the third magnetic attraction member and the third electrode are connected in parallel; the fourth conductive connector comprises the fourth electrode and the fourth magnetic attraction member; the fourth magnetic attraction member is hollow and is disposed around an outer periphery of the fourth electrode; or the fourth electrode is hollow and is disposed around an outer periphery of the fourth magnetic attraction member; or the fourth magnetic attraction member and the fourth electrode are connected in parallel; the third electrode and the fourth electrode separately comprise a conductive metal, such as, but not limited to, copper, silver, aluminum, and gold; the third magnetic attraction member and the fourth magnetic attraction member separately comprise a magnet; the first conductive connector and the second conductive connector may comprise free cutting steel for electricity conducting and magnetic attraction; or the first conductive connector comprises the first electrode and the first magnetic attraction member respectively connected to the third electrode and the third magnetic attraction member, and the second conductive connector comprises the second electrode and the second magnetic attraction member respectively connected to the fourth electrode and the fourth magnetic attraction member.

In a class of this embodiment, the cavity is matched with the second main body in shape, thus preventing the leakage of the air and e-liquid.

In a class of this embodiment, a gap distance between the column tube and the second main body is within a range of 0.1-1 mm, thus preventing the leakage of the air and e-liquid.

In a class of this embodiment, a height of the second main body is smaller or equal to a depth of the cavity.

The third objective of the disclosure is to provide an electronic cigarette; the electronic cigarette comprises the clearomizer and the cartridge; the second main body is disposed into the cavity with the first main body exposed outside the column tube.

The following advantages are associated with the clearomizer, the cartridge, and the electronic cigarette of the disclosure: the structure of the electronic cigarette allows for convenient assembly and disassembly of the clearomizer and the cartridge; and the second main body of the clearomizer is directly inserted into the cavity, thereby achieving a stable structure and enhancing user experience.

Figure 1:
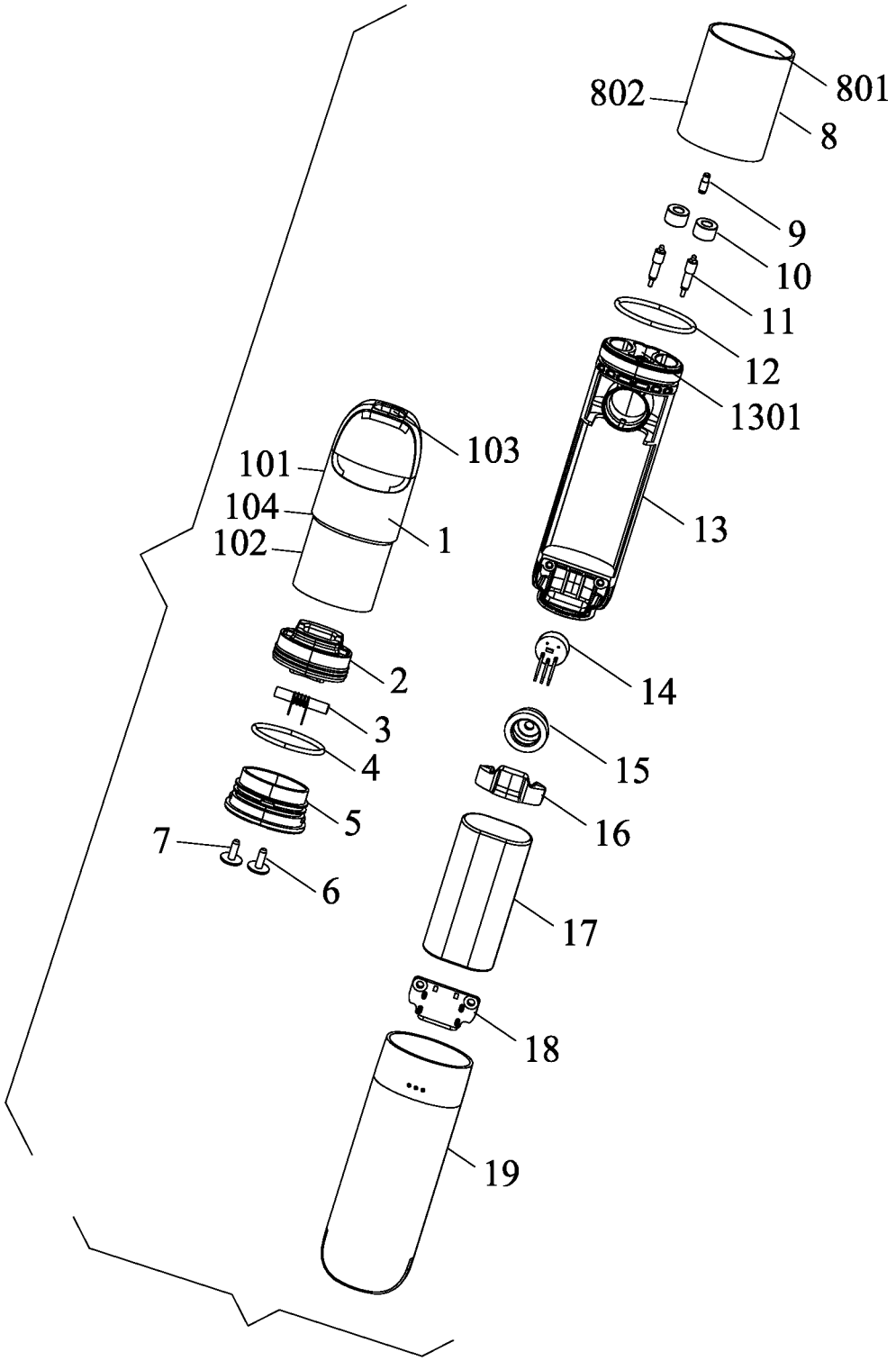
FIG. 1 is an exploded view of an electronic cigarette according to Example 1 of the disclosure.

In the drawings, the following reference numbers are used: 1. E-liquid tank; 2. E-liquid-resistant member; 3. Heating element; 4. First seal ring; 5. Base; 6. First conductive connector; 7. Second conductive connector; 8. Column tube; 9. Air conduction column; 10. Magnet; 11. Electrode; 12. Second seal ring; 13. Bracket; 14. Pneumatic switch; 15. Silicone rubber button pad; 16. Lampshade; 17. Battery; 18. Circuit element; 19. Housing; 101. First main body; 102. Second main body; 103. Mouthpiece; 104. Convex edge; 501. Groove; 502. Air conduction hole; 801. Cavity; and 802. Air inlet.

DETAILED DESCRIPTION

An electronic cigarette comprises a clearomizer and a cartridge. The clearomizer comprises a first main body 101 and a second main body 102 integrated with the first main body 101. The first main body comprises a first distal end away from the second main body 102. The first distal end comprises a mouthpiece 103. The second main body comprises a second distal end away from the first main body 101. The clearomizer further comprises a first conductive connector 6 and a second conductive connector 7 both disposed on the second distal end. Preferably, the first conductive connector 6 is formed integrally with the second conductive connector 7 or can be affixed thereto using welding, adhesives, or the like.

The second main body 102 has a reduced diameter with respect to the first main body 101. The first main body 101 comprises a first proximal end disposed near the second main body 102 and a convex edge 104 protruding from the first proximal end. The convex edge 104 abuts against one end of the cartridge to limit change in position of the cartridge, thereby preventing the second main body 102 from being inserted too deep into the cartridge. For example, the second main body 102 is inserted too forcefully, causing the interruption of smooth airflow in the e-liquid tank 1.

The second distal end comprises at least one recess 501 and an air conduction hole 502 disposed in the at least one recess 501. The at least one recess 501 communicates with the air conduction hole 502 and extends from side to side through the second distal end. The at least one recess 501 is configured to conduct air into the air conduction hole 502. The cartridge comprises a column tube. The column tube comprises an open top and a bottom wall, and a cavity 801 is formed in the column tube 8. The second main body is disposed in the cavity 801 and abuts against the bottom wall of the column tube 8. Air flows through the at least one recess 501, via the air conduction hole 502, and into the clearomizer.

The cartridge further comprises a third conductive connector, a fourth conductive connector, two electrodes 11, two magnets 10, and a housing 19 communicating with the column tube 8. The first conductive connector, the second conductive connector, the third conductive connector, and the fourth conductive connector are disposed on the bottom wall of the column tube 8, wherein the first conductive connector 6 and the second conductive connector 7 are electrically connected to the third conductive connector and the fourth conductive connector, respectively. The two electrodes 11 refer to a third electrode and a fourth electrode. The two magnets 10 refer to a third magnetic attraction member and a fourth magnetic attraction member. The third conductive connector comprises the third electrode and the third magnetic attraction member, and the fourth conductive connector comprises the fourth electrode and the fourth magnetic attraction member.

The cartridge further comprises an air conduction column and the bottom wall of the column tube comprises a concave portion 1301. The air conduction column is disposed in the concave portion. The first conductive connector 6 and the second conductive connector 7 are disposed outside the concave portion 1301; the cartridge further comprises a battery 17, a circuit element 18, and a bracket 13. The bracket 13 is disposed in the housing 19. The battery 17 and the circuit element 18 are disposed in the bracket 13. The bracket 13 comprise a top portion functioning as the bottom wall of the column tube. The column tube 8 comprises at least one air inlet 802 above the bottom wall. External air flows through the at least one air inlet 802, into the cavity 801, through the at least one recess 501, via the air conduction hole 502, and into the clearomizer.

Example 1

Figure 2:
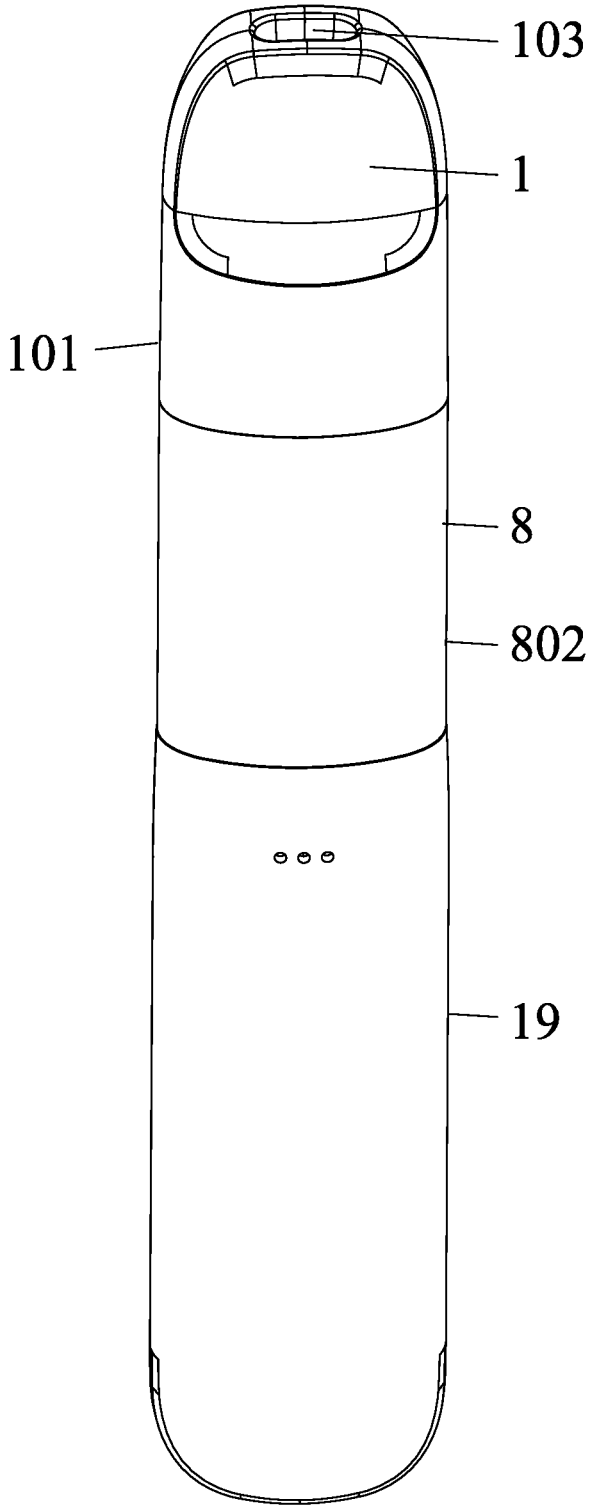
FIG. 2 is a perspective view of an electronic cigarette according to Example 1 of the disclosure.
Figure 3:
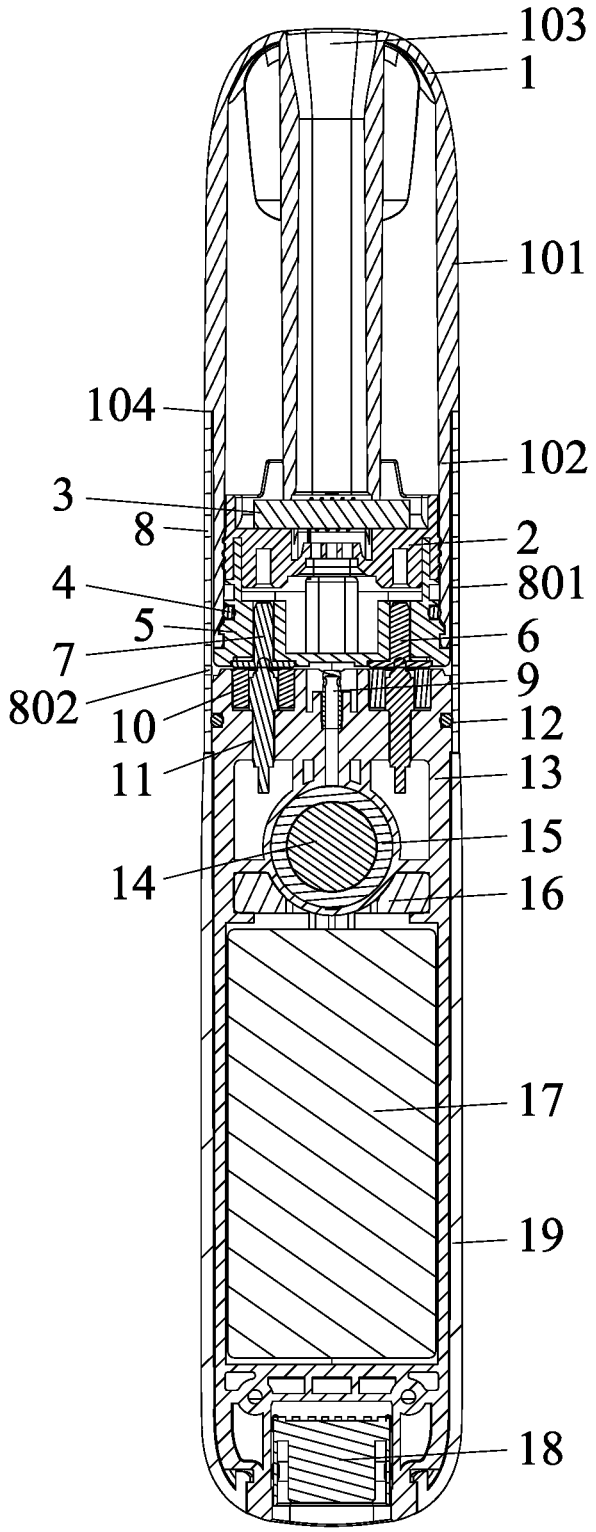
FIG. 3 is a cross-sectional view of an electronic cigarette according to Example 1 of the disclosure.
Figure 4:
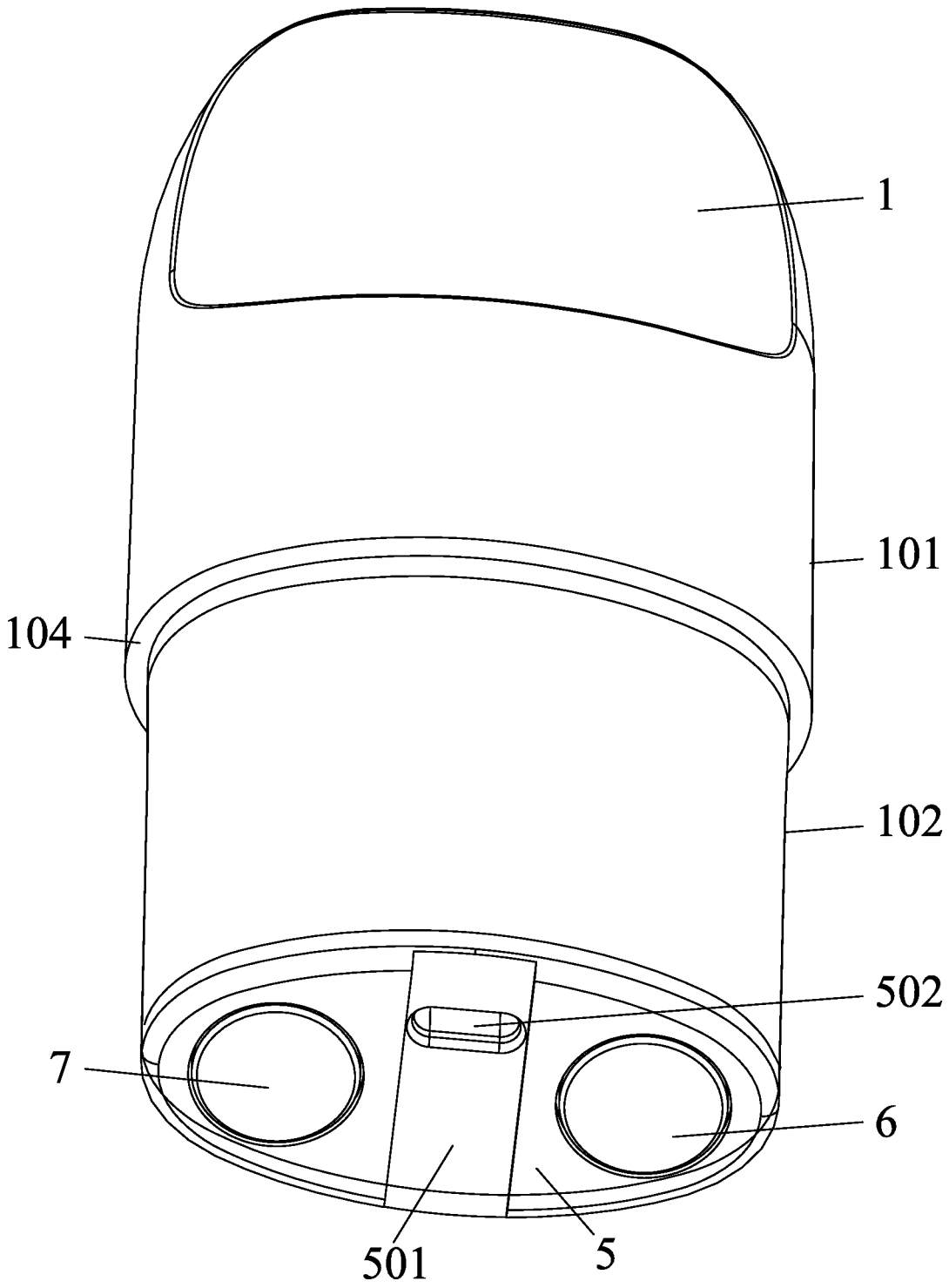
FIG. 4 is a perspective view of a clearomizer according to Example 1 of the disclosure.
Figure 5:
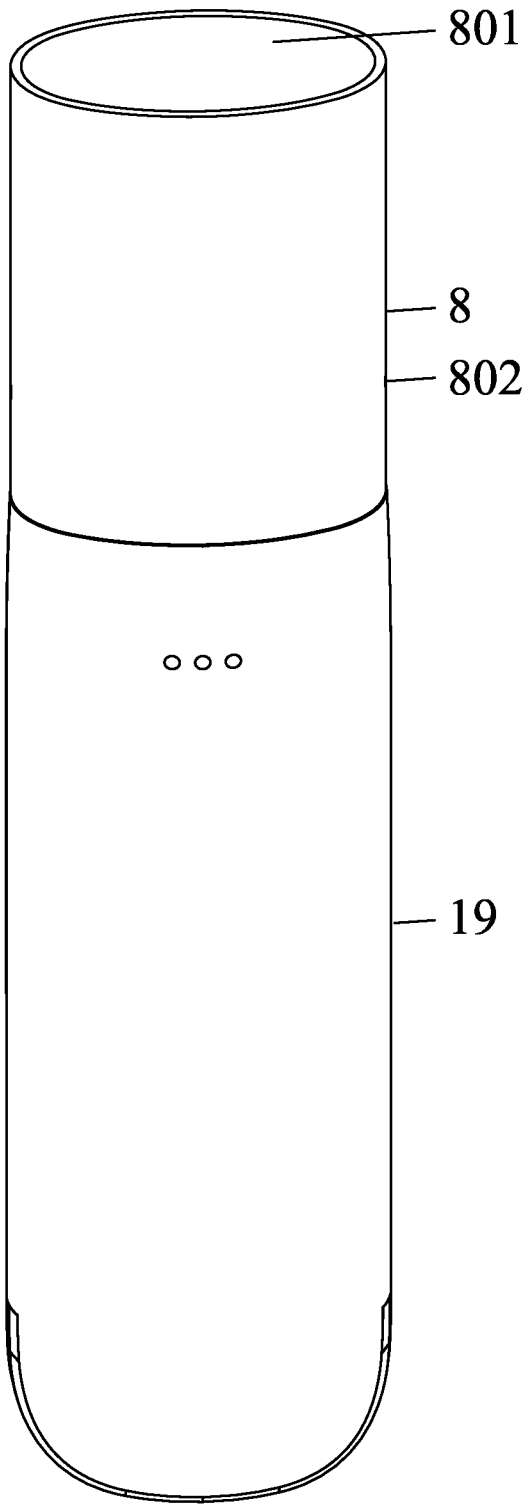
FIG. 5 is a perspective view of a cartridge according to Example 1 of the disclosure.
Figure 6:
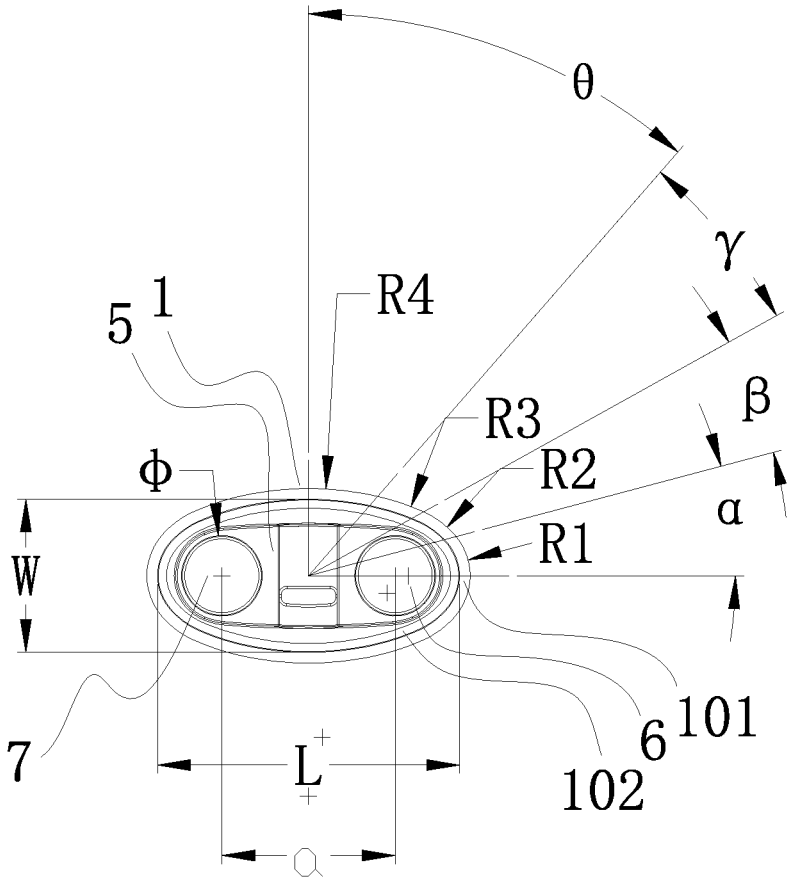
FIG. 6 is a bottom view illustrating a cross-sectional dimension of a clearomizer according to Example 1 of the disclosure.
Figure 7:
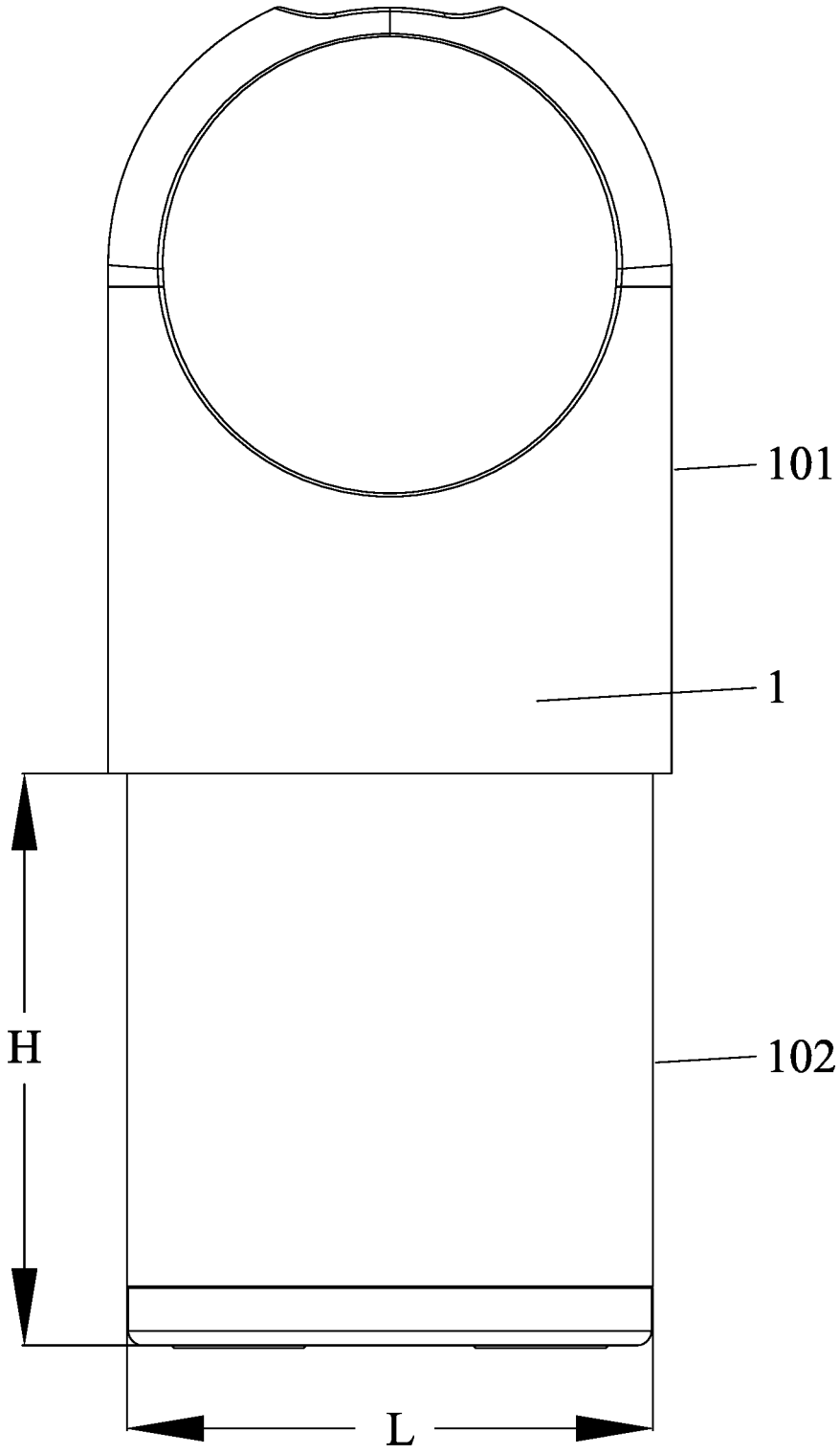
FIG. 7 is a front view of a clearomizer according to Example 1 of the disclosure.
Figure 8:
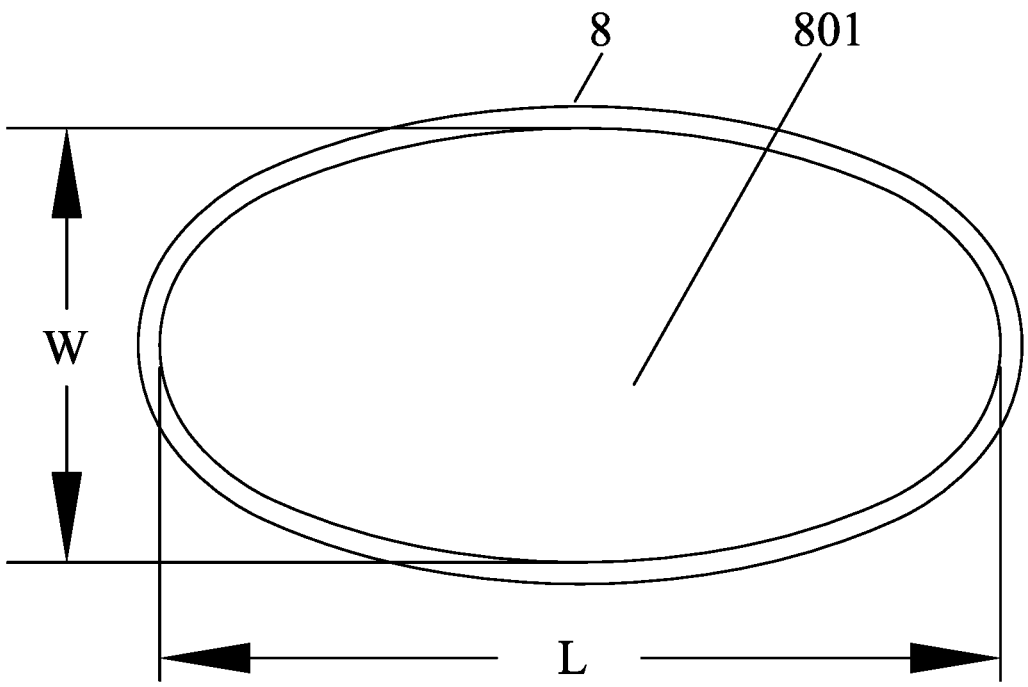
FIG. 8 is a top view illustrating a cross-sectional dimension of a cartridge according to Example 1 of the disclosure.

Referring to FIGS. 1-8, an electronic cigarette comprises a clearomizer and a cartridge. The clearomizer comprises an e-liquid tank 1, an e-liquid-resistant member 2, a heating element 3, a first seal ring 4, a base 5, a first conductive connector 6, and a second conductive connector 7. The heating element 3 is disposed in the e-liquid-resistant member 2 to atomize e-liquid. The e-liquid-resistant member 2 is disposed on the base 5 and the base 5 abuts against a bottom edge of the e-liquid tank 1 to prevent the e-liquid from leaking out of the e-liquid tank. The first seal ring 4 is disposed around the base 5 to prevent leakage of air, vapor or smoke. The first conductive connector 6 and second conductive connector 7 are separately disposed on a bottom surface of the base 5 to conduct electricity.

The cartridge comprises a column tube 8, an air conduction column 9, two magnets 10 (a third magnetic member and a fourth magnetic member), two electrodes 11 (a third electrode and a fourth electrode), a second seal ring 12, a bracket 13, a pneumatic switch 14, a silicone rubber button pad 15, a lampshade 16, a battery 17, a circuit element 18, and a housing 19. An output terminal of the battery 17 is disposed on an input terminal of the circuit element 18 to supply electricity. The pneumatic switch 14 is secured to the circuit element 18 to receive electricity. The silicone rubber button pad 15, the battery 17, and the circuit element 18 are disposed in the bracket 13. The pneumatic switch 14 is disposed in the silicone rubber button pad 15. The lampshade 16 is disposed both on the bracket 13 and above the pneumatic switch 14. The air conduction column 9 is passed through a top portion of the bracket 13 to conduct air into the bracket. The two magnets 10 are hollow and are separately secured to one end of the top portion of the bracket 13 to attract the first conductive connector 6 and the second conductive connector 7, so that the bracket 13 is secured to the clearomizer. The two electrodes 11 are passed through the two magnets 10, respectively and are disposed therein to make electrical contact with the first conductive connector 6 and the second conductive connector 7. An output terminal of the circuit element 18 is disposed on the two electrodes 11. The bracket 13 is secured within the housing 19. The column tube 8 is disposed on the bracket 18 and abuts against a top edge of the housing 19. The second seal ring 12 is disposed around the top portion of the bracket 13 to seal the column tube 8 and fasten the column tube 8 on the housing 19.

The column tube 8 comprises an open top and a bottom wall, and a cavity 801 is formed in the column tube 8. The e-liquid tank 1 comprises a first main body 101 and a second main body 102 integrated with the first main body 101. The second main body 102 has a reduced diameter with respect to the first main body 101. The first main body 101 comprises a first proximal end disposed near the second main body 102 and a convex edge 104 protruding from the first proximal end. The convex edge 104 abuts against a top end of the column tube 8 to limit change in position of the cartridge, thereby preventing the second main body 102 from being inserted too deep into the cavity 801. The bottom surface of the base 5 comprises a groove 501 and an air conduction hole 502. The groove 501 communicates with the air conduction hole 502 and extends from side to side through the bottom surface of the base 5. The groove 501 is configured to conduct air into the air conduction hole 502. The second main body 102 comprises a second distal end away from the first main body 101. The second main body 102 is disposed in the cavity 801 and the second distal end abuts against the bottom wall of the column tube 8, so that air flows through the groove 501, via the air conduction hole 502, and into the clearomizer.

The second main body 102 has an outer length L of 18.3±0.5 mm, an outer width W of 9.3±0.5 mm, and an outer height H of 19.9±0.5 mm. The cavity 801 has an inner length L of 18.64±0.5 mm and an inner width W of 9.64±0.5 mm. A quarter of outer perimeter of the second main body 102 comprises a first arc segment R1, a second arc segment R2, a third arc segment R3, and a fourth arc segment R4. The fourth arc segment R4 is a segment of a circle with a radius of 18.67±0.5 mm and has a central angle θ of 41°±1°. The term "central angle" as used herein refers to an angle formed by two radii with the center of a circle as the vertex. The third arc segment R3 is a segment of a circle with a radius of 15.00±0.5 mm and has a central angle γ of 20°±1°. The second arc segment R2 is a segment of a circle with a radius of 5.43±0.5 mm and has a central angle β of 14°±1°. The first arc segment R1 is a segment of a circle with a radius of 3.75±0.5 mm and has a central angle α of 15°±1°. A distance a between centers of the first conductive connector 6 and the second conductive connector 7 is within a range of 10.5±0.5 mm. The first conductive connector 6 and the second conductive connector 7 both have a diameter φ of 4.8±0.5 mm.

Example 2

Figure 9:
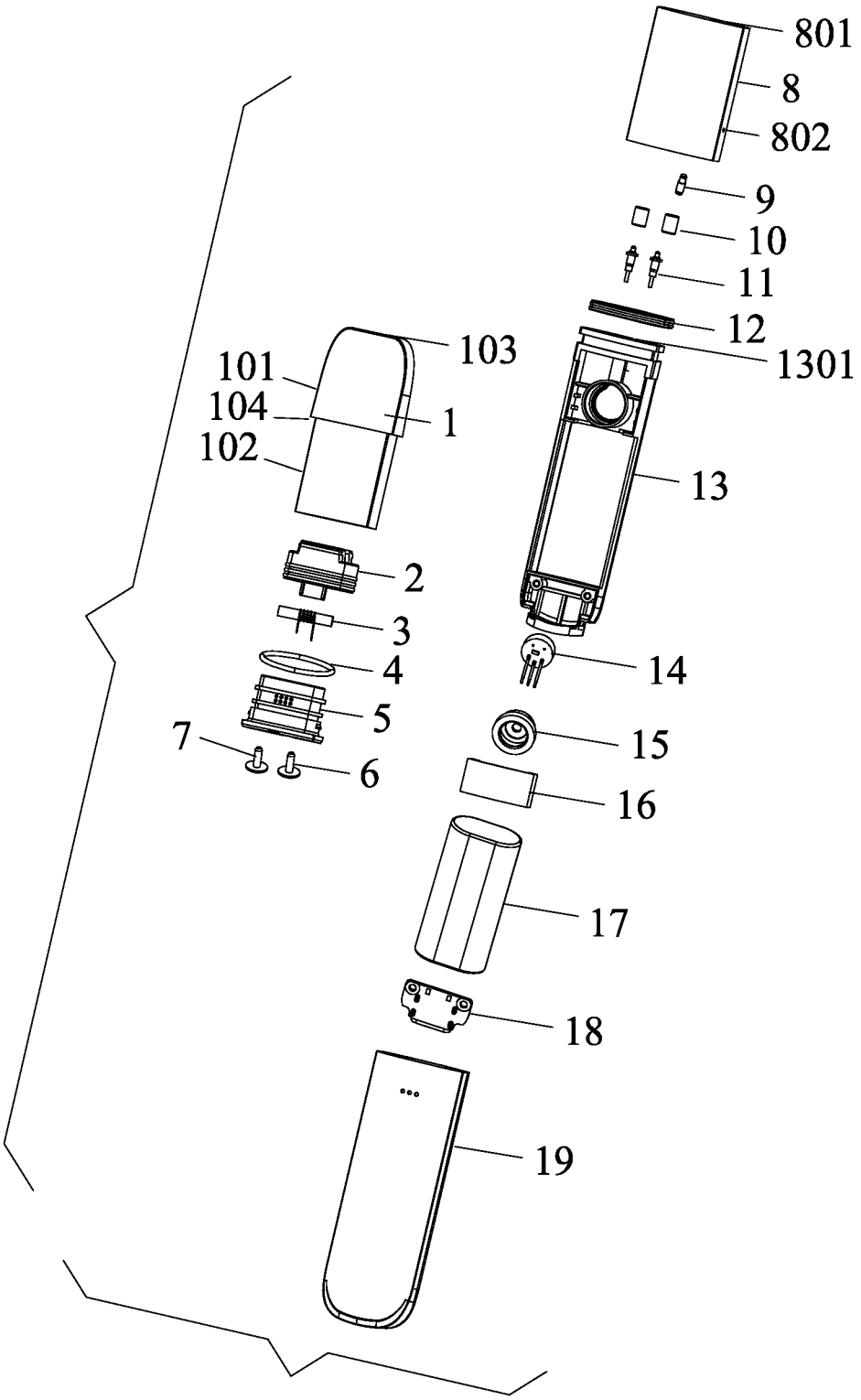
FIG. 9 is an exploded view of an electronic cigarette according to Example 2 of the disclosure.
Figure 10:
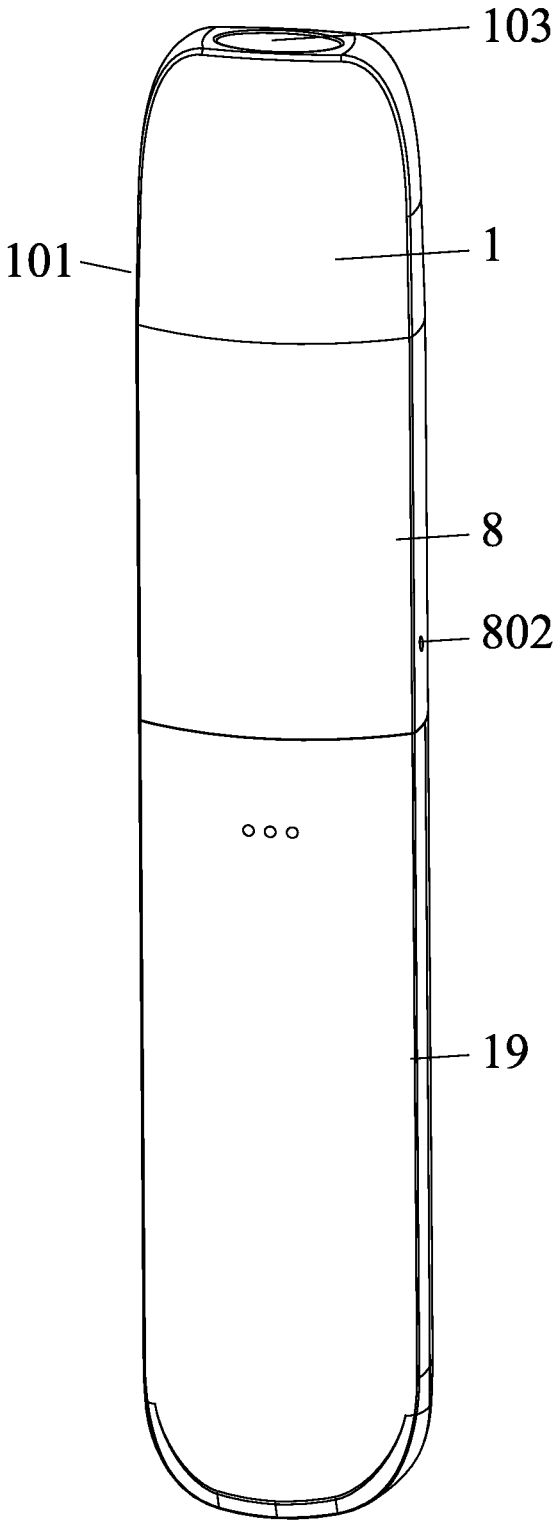
FIG. 10 is a perspective view of an electronic cigarette according to Example 2 of the disclosure.
Figure 11:
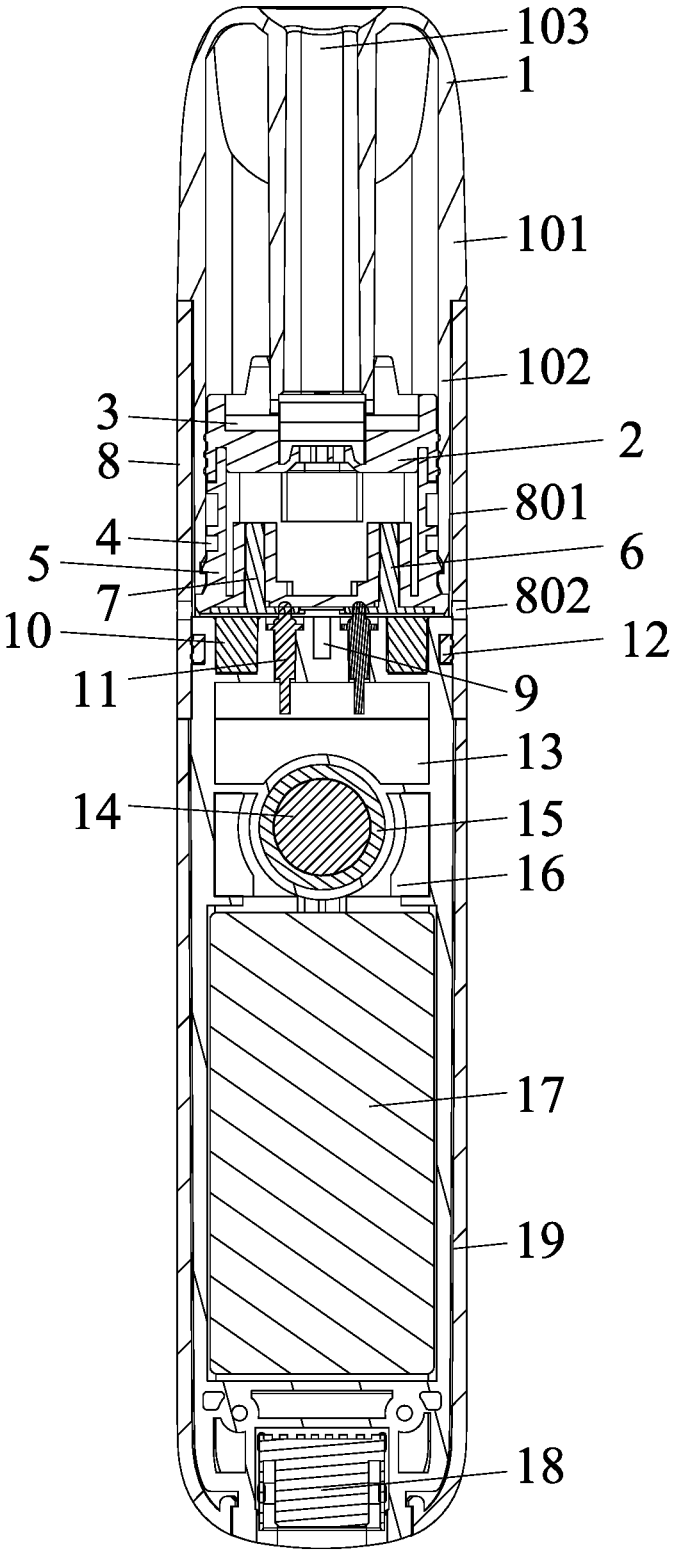
FIG. 11 is a cross-sectional view of an electronic cigarette according to Example 2 of the disclosure.
Figure 12:
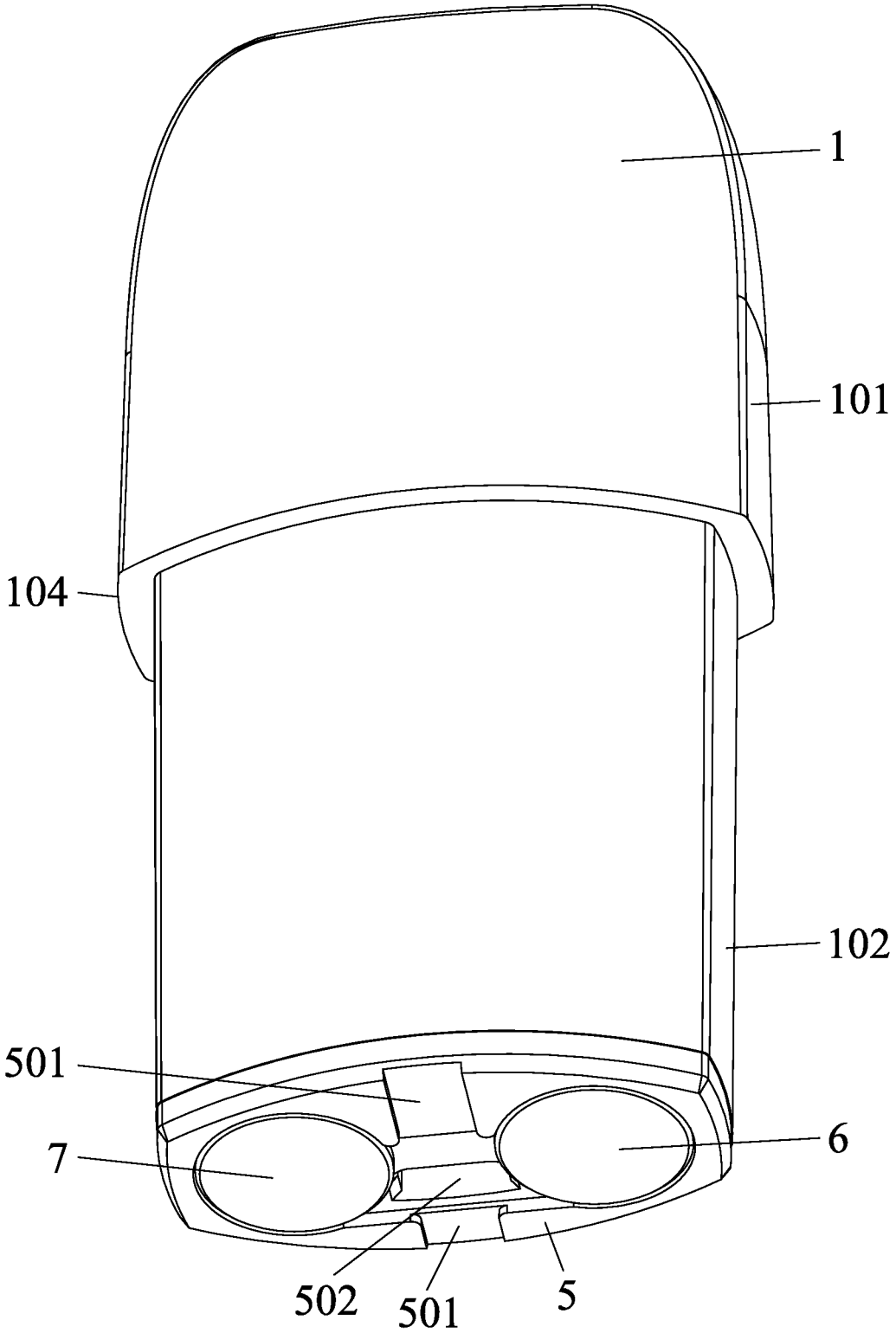
FIG. 12 is a perspective view of a clearomizer according to Example 2 of the disclosure.
Figure 13:
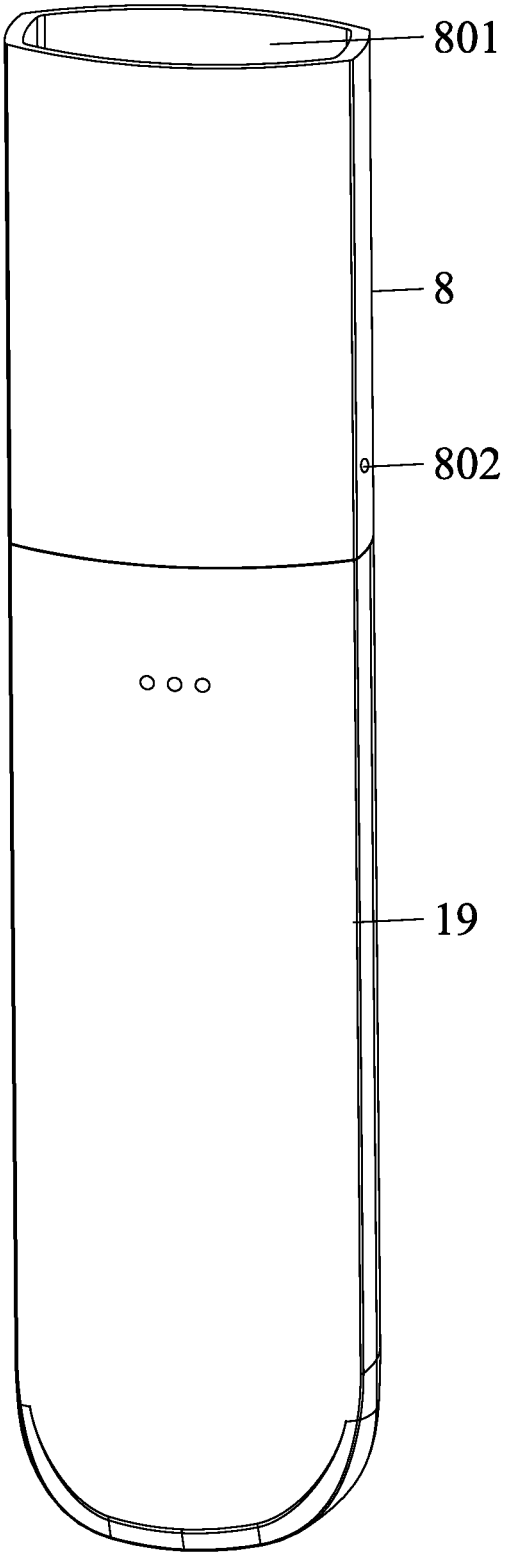
FIG. 13 is a perspective view of a cartridge according to Example 2 of the disclosure.
Figure 14:
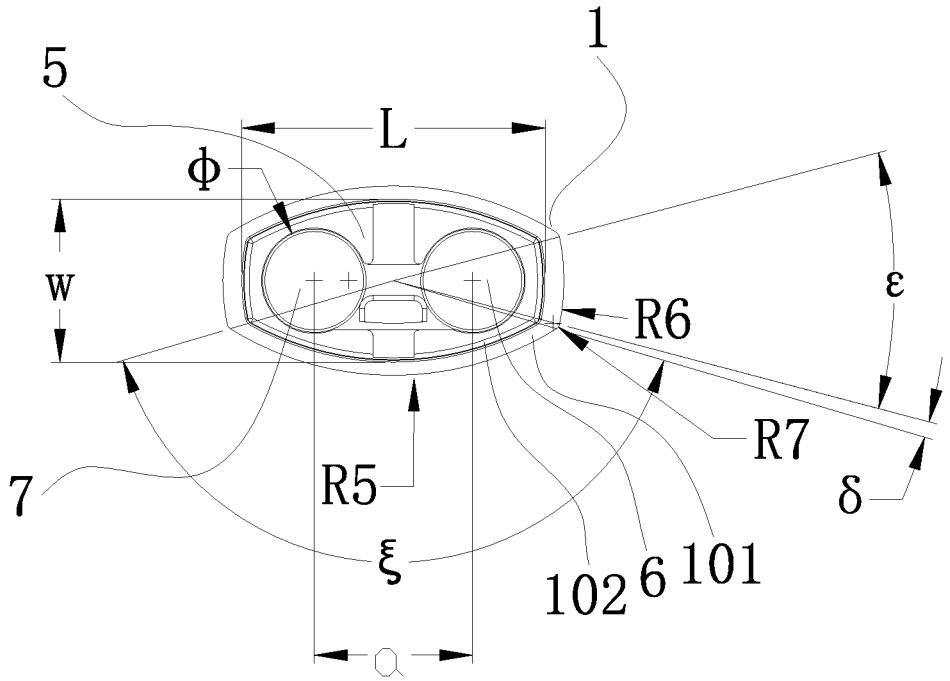
FIG. 14 is a bottom view illustrating a cross-sectional dimension of a clearomizer according to Example 2 of the disclosure.
Figure 15:
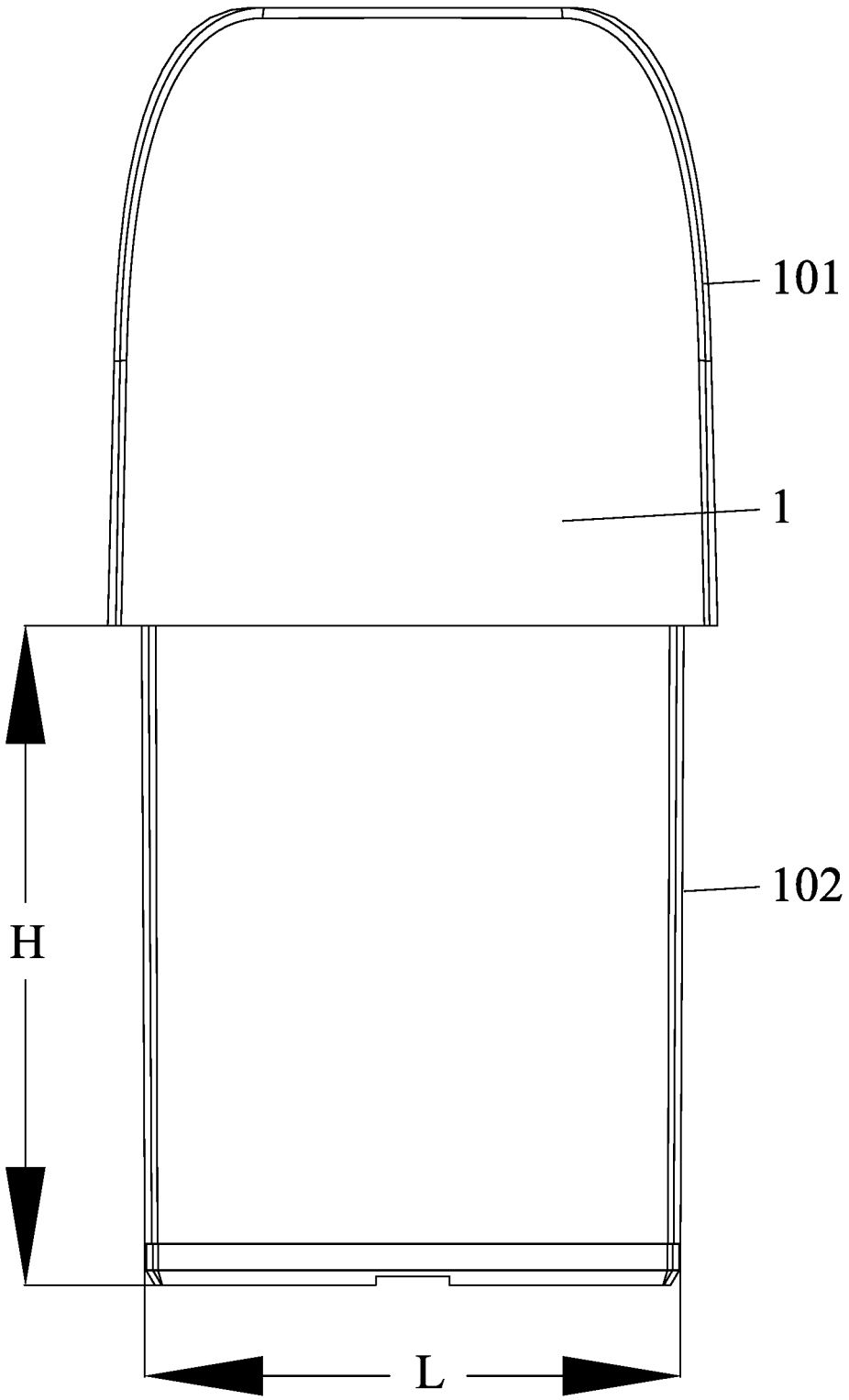
FIG. 15 is a front view of a clearomizer according to Example 2 of the disclosure.
Figure 16:
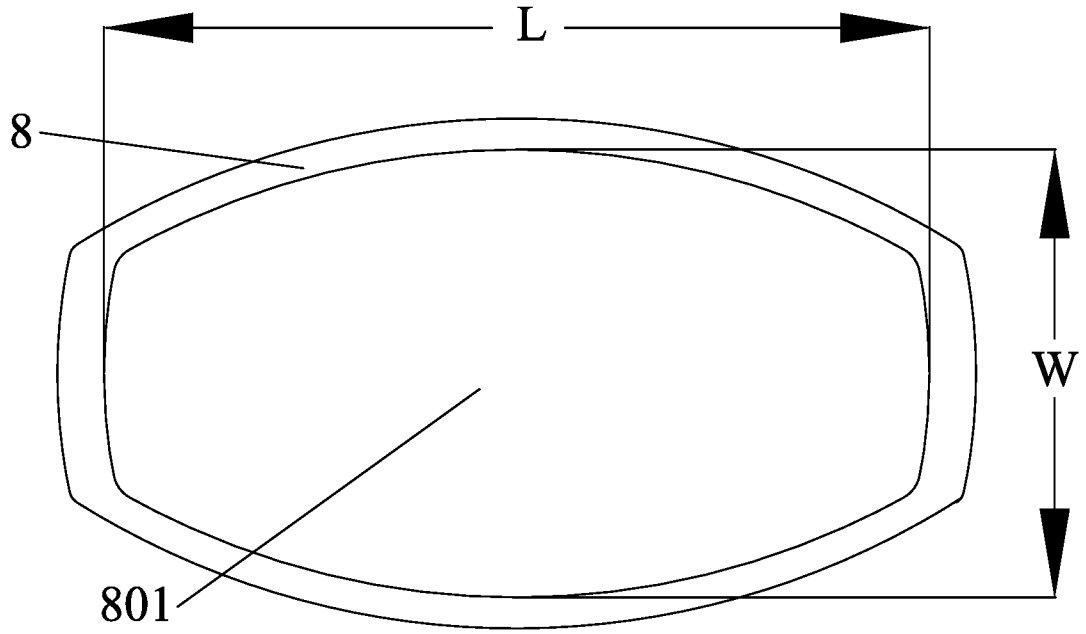
FIG. 16 is a top view illustrating a cross-sectional dimension of a cartridge according to Example 2 of the disclosure.

Referring to FIGS. 9-16, an electronic cigarette comprises a clearomizer and a cartridge. The clearomizer comprises an e-liquid tank 1, an e-liquid-resistant member 2, a heating element 3, a first seal ring 4, a base 5, a first conductive connector 6, and a second conductive connector 7. The heating element 3 is disposed in the e-liquid-resistant member 2 to atomize e-liquid. The e-liquid-resistant member 2 is disposed on the base 5 and the base 5 abuts against a bottom edge of the e-liquid tank 1 to prevent the e-liquid from leaking out of the e-liquid tank. The first seal ring 4 is disposed around the base 5 to prevent leakage of air, vapor or smoke. The first conductive connector 6 and second conductive connector 7 are separately disposed on a bottom surface of the base 5 to conduct electricity.

The cartridge comprises a column tube 8, an air conduction column 9, two magnets 10 (a third magnetic member and a fourth magnetic member), two electrodes 11 (a third electrode and a fourth electrode), a second seal ring 12, a bracket 13, a pneumatic switch 14, a silicone rubber button pad 15, a lampshade 16, a battery 17, a circuit element 18, and a housing 19. An output terminal of the battery 17 is disposed on an input terminal of the circuit element 18 to supply electricity. The pneumatic switch 14 is secured to the circuit element 18 to receive electricity. The silicone rubber button pad 15, the battery 17, and the circuit element 18 are disposed in the bracket 13. The pneumatic switch 14 is disposed in the silicone rubber button pad 15. The lampshade 16 is disposed both on the bracket 13 and above the pneumatic switch 14. The air conduction column 9 is passed through a top portion of the bracket 13 to conduct air into the bracket. The two magnets 10 are secured to one end of the top portion of the bracket 13 to attract the first conductive connector 6 and the second conductive connector 7, so that the bracket 13 is secured to the clearomizer. The two electrodes 11 are separately passed through the top portion of the bracket 13 and are secured therein to make electrical contact with the first conductive connector 6 and the second conductive connector 7. An output terminal of the circuit element 18 is disposed on the two electrodes 11. The column tube 8 is disposed on the bracket 18 and abuts against a top edge of the housing 19. The bracket 13 is secured within the housing 19. The second seal ring 12 is disposed around the top portion of the bracket 13 to seal the column tube 8 and fasten the column tube 8 on the housing 19.

The column tube 8 comprises an open top and a bottom wall, and a cavity 801 is formed in the column tube 8. The e-liquid tank 1 comprises a first main body 101 and a second main body 102 integrated with the first main body 101. The second main body 102 has a reduced diameter with respect to the first main body 101. The first main body 101 comprises a first proximal end disposed near the second main body 102 and a convex edge 104 protruding from the first proximal end. The convex edge 104 abuts against a top end of the column tube 8 to limit change in position of the cartridge, thereby preventing the second main body 102 from being inserted too deep into the cavity 801. The bottom surface of the base 5 comprises a groove 501 and an air conduction hole 502. The groove 501 communicates with the air conduction hole 502 and extends from side to side through the bottom surface of the base 5. The groove 501 is configured to conduct air into the air conduction hole 502. The second main body 102 comprises a second distal end away from the first main body 101. The second main body 102 is disposed in the cavity 801 and the second distal end abuts against the concave portion, so that air flows through the groove 501, via the air conduction hole 502, and into the clearomizer.

The second main body 102 has an outer length L of 18.4±0.5 mm, an outer width W of 9.9±0.5 mm, and an outer height H of 22.4±0.5 mm. The cavity 801 has an inner length L of 18.60±0.5 mm and an inner width W of 10.10±0.5 mm. A quarter of outer perimeter of the second main body 102 comprises a second arc segment R5, a third arc segment R6, and a fourth arc segment R7. The second arc segment R5 is a segment of a circle with a radius of 18.70±0.5 mm and has a central angle ζ of 147°±1°. The term "central angle" as used herein refers to an angle formed by two radii with the center of a circle as the vertex. The third arc segment R6 is a segment of a circle with a radius of 13.06±0.5 mm and has a central angle c of 30°±1°. The fourth arc segment R7 is a segment of a circle with a radius of 0.4±0.5 mm and has a central angle δ of 2°±1°. A distance a between centers of the first conductive connector 6 and the second conductive connector 7 is within a range of 9.6±0.5 mm. The first conductive connector 6 and the second conductive connector 7 both have a diameter φ of 6.3±0.5 mm.

It will be obvious to those skilled in the art that changes and modifications may be made, and therefore, the aim in the appended claims is to cover all such changes and modifications.

What is claimed is:

1. A clearomizer, comprising a first main body and a second main body; wherein:

the first main body comprises a first distal end away from the second main body; the first distal end comprises a mouthpiece;

the second main body comprises a second distal end away from the first main body; the clearomizer further comprises a first conductive connector and a second conductive connector both disposed on the second distal end;

the first conductive connector and the second conductive connector each are a singular conductive metal attractable by a magnet; and/or the first conductive connector comprises a first electrode and a first magnetic attraction member; the first magnetic attraction member is hollow and is disposed around an outer periphery of the first electrode; or the first electrode is hollow and is disposed around an outer periphery of the first magnetic attraction member; or the first magnetic attraction member and the first electrode are connected in parallel; the second conductive connector comprises a second electrode and a second magnetic attraction member; the second magnetic attraction member is hollow and is disposed around an outer periphery of the second electrode; or the second electrode is hollow and is disposed around an outer periphery of the second magnetic attraction member; or the second magnetic attraction member and the second electrode are connected in parallel.

2. The clearomizer of claim 1, wherein:

the second distal end comprises at least one recess and an air conduction hole disposed in the at least one recess; the at least one recess communicates with the air conduction hole and extends from side to side through the second distal end; and/or the second main body has a reduced diameter with respect to the first main body; the first main body comprises a first proximal end disposed near the second main body and a convex edge protruding from the first proximal end.

3. The clearomizer of claim 2, wherein the first main body comprises a chamfer disposed to an edge of the first distal end; the at least one recess extends to the chamfer.

4. The clearomizer of claim 1, wherein:

the air conduction hole is disposed outside a central area of the second distal end; and/or the first conductive connector and the second conductive connector are symmetrically disposed relative to a straight center line of the second distal end.

5. The clearomizer of claim 1, wherein a cross-section of the second main body is centrosymmetric around a central point.

6. The clearomizer of claim 1, wherein a cross-section of the second main body has a length of 15-21 mm; and/or a cross-section of the second main body has a width of 7-12 mm; and/or the second main body has a height of 15-27 mm.

7. The clearomizer of claim 5, wherein the cross-section of the second main body comprises an outline having four curves that are connected to one another; each two of the four curves are symmetrical with one another with respect to a central line or the central point of the cross-section of the second main body; and each curve comprises a first arc, a second arc, a third arc, and a fourth arc that are connected sequentially to one another.

8. The clearomizer of claim 7, wherein the first arc is an arc of a circle with a radius of 3.3-4.2 mm and has a central angle of 13.5°-16.5°; the second arc is an arc of a circle with a radius of 5-6 mm and has a central angle of 12.7°-15.7°; the third arc is an arc of a circle with a radius of 14.5-15.5 mm and has a central angle of 18°-21.5°; the fourth arc is an arc of a circle with a radius of 18.1-19.1 mm and has a central angle of 39.5°-42°.

9. The clearomizer of claim 6, wherein the cross-section of the second main body has a length of 18-18.6 mm; and/or the cross-section of the second main body has a width of 9-9.9 mm; and/or the second main body has a height of 19-23.5 mm.

10. The clearomizer of claim 5, wherein the cross-section of the second main body comprises an outline having two second arcs and two third arcs, and the two second arcs and the two third arcs are alternately connected in sequence and are centrosymmetric around a central point.

11. The clearomizer of claim 10, wherein each of the two second arcs is an arc of a circle with a radius of 17.5-19.5 mm and has a central angle of 146°-153°; and each of the two third arcs is an arc of a circle with a radius of 12-14 mm and has a central angle of 27°-34°; and/or the cross-section of the second main body has a length of 18-18.8 mm and a width of 9.5-10.5 mm; and/or the outline of the cross-section of the second main body further comprises a fourth arc disposed between each second arc and one third arc; the fourth arc is an arc of a circle with a radius of 0.2-0.6 mm and has a central angle of 1°-3°.

12. The clearomizer of claim 1, wherein the first conductive connector and the second conductive connector each are a singular conductive metal attractable by a magnet; and a distance between centers of the first conductive connector and the second conductive connector is within a range of 9-11 mm; and/or the first conductive connector and the second conductive connector both have a diameter of 4-7 mm.

13. A cartridge, comprising a clearomizer, a column tube for accommodating the clearomizer, a third conductive connector, and a fourth conductive connector; wherein:

the clearomizer comprises a first main body and a second main body; wherein, the first main body comprises a first distal end away from the second main body; the first distal end comprises a mouthpiece; the second main body comprises a second distal end away from the first main body; the clearomizer further comprises a first conductive connector and a second conductive connector both disposed on the second distal end;

the column tube comprises an open top, a cavity, and a bottom wall; the second main body is inserted through the open top into the cavity; the third conductive connector and the fourth conductive connector are disposed on the bottom wall and are electrically connected to the first conductive connector and the second conductive connector, respectively;

the third conductive connector and the fourth conductive connector each are a singular conductive metal attractable by a magnet; and/or the third conductive connector comprises a third electrode and a third magnetic attraction member; the third magnetic attraction member is hollow and is disposed around an outer periphery of the third electrode; or the third electrode is hollow and is disposed around an outer periphery of the third magnetic attraction member; or the third magnetic attraction member and the third electrode are connected in parallel; the fourth conductive connector comprises a fourth electrode and a fourth magnetic attraction member; the fourth magnetic attraction member is hollow and is disposed around an outer periphery of the fourth electrode; or the fourth electrode is hollow and is disposed around an outer periphery of the fourth magnetic attraction member; or the fourth magnetic attraction member and the fourth electrode are connected in parallel.

14. The cartridge of claim 13, wherein:

the cartridge further comprises an air conduction column and the bottom wall of the column tube comprises a concave portion; the air conduction column is disposed in the concave portion; the first conductive connector and the second conductive connector are disposed outside the concave portion; and/or the cartridge further comprises a battery, a circuit element, a bracket, and a housing communicating with the column tube; the bracket is disposed in the housing; the battery and the circuit element are disposed in the bracket; the bracket comprises a top portion functioning as the bottom wall of the column tube; the column tube comprises at least one air inlet facing the bottom wall.

15. The cartridge of claim 13, wherein the cavity is matched with the second main body in shape; and/or a gap distance between the column tube and the second main body is within a range of 0.1-1 mm; and/or a height of the second main body is smaller or equal to a depth of the cavity.

16. An electronic cigarette, comprising the clearomizer of claim 1 and a cartridge; wherein the cartridge comprises a column tube for accommodating the clearomizer, a third conductive connector, and a fourth conductive connector; the column tube comprises an open top, a cavity, and a bottom wall; the second main body is inserted through the open top into the cavity; the third conductive connector and the fourth conductive connector are disposed on the bottom wall and are electrically connected to the first conductive connector and the second conductive connector, respectively; the second main body is disposed into the cavity, and the first main body is exposed outside the column tube.

* * * * *